United States Patent [19]

Nowak et al.

[11] 4,098,255

[45] Jul. 4, 1978

[54] DUAL FUEL RADIANT TUBE BURNER

[75] Inventors: Leonard G. Nowak, Ypsilanti; Paul K. Shefsiek, Farmington, both of Mich.

[73] Assignee: Thermo Electron Corporation, Waltham, Mass.

[21] Appl. No.: 721,139

[22] Filed: Sep. 7, 1976

[51] Int. Cl.[2] ..... F24C 3/00

[52] U.S. Cl. ..... 126/91 A; 431/284; 431/285; 431/351

[58] Field of Search ..... 126/91 A; 431/174, 284, 431/285, 351, 352, 353, 187, 188

[56] References Cited

U.S. PATENT DOCUMENTS

| | | | |
|---|---|---|---|
| 2,796,118 | 6/1957 | Parker et al. | 126/91 A |
| 3,163,203 | 12/1964 | Ihlenfield | 431/284 |
| 3,229,748 | 1/1966 | Spielman | 431/188 |
| 3,265,114 | 8/1966 | Childree | 431/285 |
| 3,729,285 | 4/1973 | Schedersky | 431/351 |
| 3,822,654 | 7/1974 | Ghelfi | 431/284 |
| 4,014,316 | 3/1977 | Jones et al. | 431/187 |

*Primary Examiner*—Carroll B. Dority, Jr.
*Attorney, Agent, or Firm*—James L. Neal; David W. Gomes

[57] ABSTRACT

A radiant tube burner mixes liquid fuel and/or gaseous fuel with air for combustion in a radiant tube to produce a quiet and stable luminous flame through the entire length of the radiant tube. A flame holding plate is positioned within the radiant tube to define a feed zone and a combustion zone. A liquid fuel nozzle positioned centrally in the plate directs fuel through the plate and into the combustion zone. The plate defines a series of apertures circumscribing the nozzle and another passage outward from the series of openings and concentric therewith. Combustion air is proportioned and admitted to the combustion zone through the series of openings and the passage. Gaseous fuel may be admitted to the combustion zone through the series of openings.

12 Claims, 1 Drawing Figure

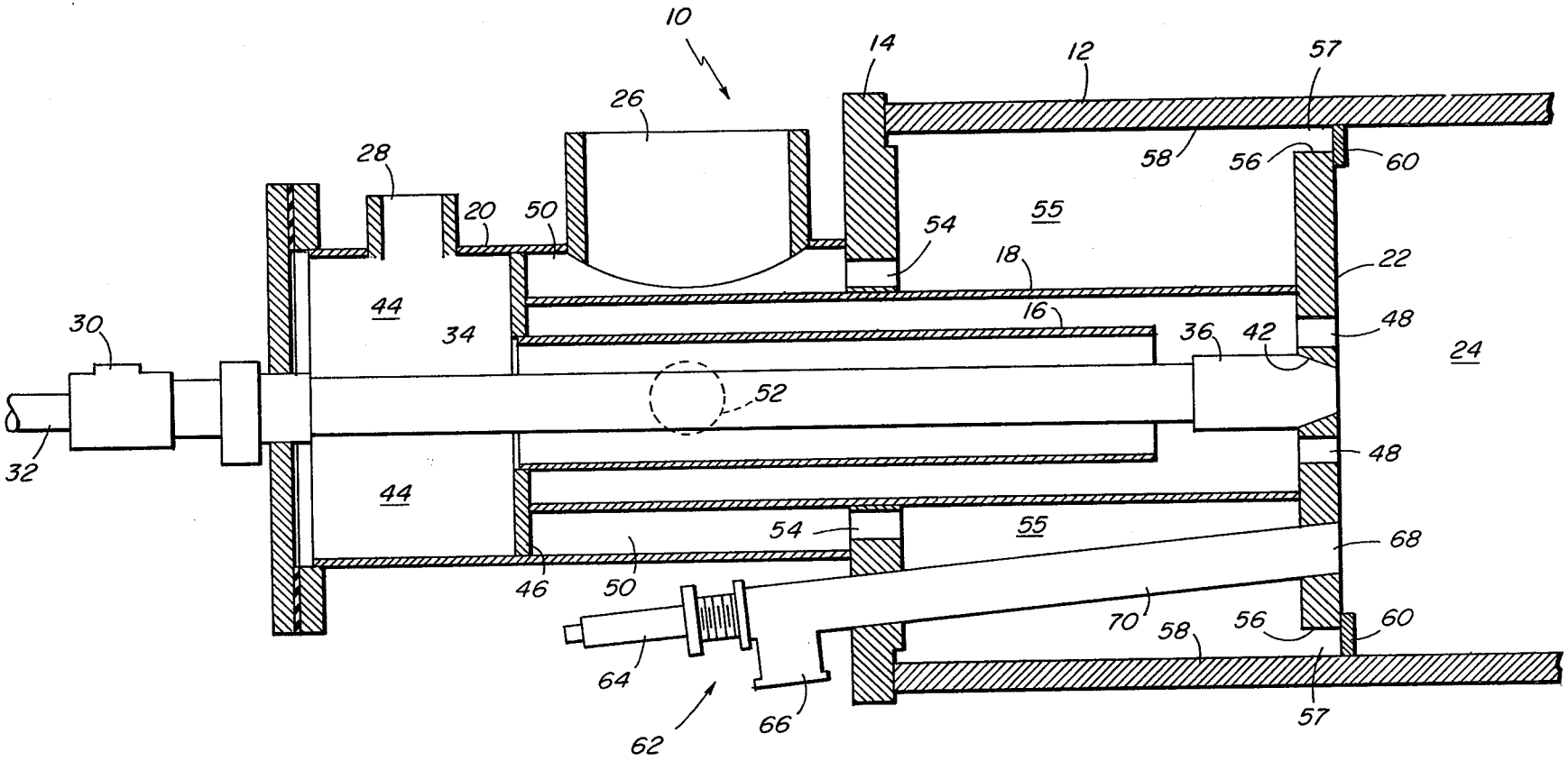
10
12
14
16
18
20
22
24
26
28
30
32
34
36
42
44
46
48
50
52
54
55
56
57
58
60
62
64
66
68
70

DUAL FUEL RADIANT TUBE BURNER

BACKGROUND OF THE INVENTION

Radiant tubes provide an indirect heat source for industrial furnaces and are particularly useful in heat-treating furnaces filled with a protective gas atmosphere. The tubes isolate the products of combustion from the furnace interior and therefore from the workpiece. Combustion within the tubes provides the heat for radiation and typically extends over the entire tube length. Most radiant tube burners have been designed for use with gaseous fuel, and development of fuel oil burners has correspondingly lagged. Fuel oil radiant tube burners typically require high velocity combustion air to prevent tube failure caused by fast combustion of the fuel oil after injection into the tube. Unfortunately, this technique results in excessive operating noise, unstable combustion, uneven temperature distribution and inefficient fuel utilization.

Accordingly, it is an object of the present invention to provide a radiant tube burner capable of operation with either gaseous or liquid fuel.

Another object of this invention is to provide a radiant tube burner which produces a stable luminous flame over the entire length of the radiant tube. Correspondingly, an object of this invention is to provide even temperature distribution over the entire radiant tube length.

A further object of the present invention is to provide a radiant tube burner which operates quietly on liquid fuel.

Another object of the present invention is to provide a fuel efficient radiant tube burner.

SUMMARY OF THE INVENTION

A radiant tube burner capable of burning both liquid and gaseous fuel is provided. Typically, the liquid fuel is heating oil and the gaseous fuel is natural gas. A fuel burner module includes a flame holding plate which defines the beginning of the combustion zone within the radiant tube. Atomized liquid fuel is delivered centrally through the flame holding plate. Combustion air is delivered through a series of apertures in the holding plate and directed into the atomized liquid fuel. This disperses the liquid fuel and causes a slow burning of the fuel over the entire length of the radiant tube. Proportioning means divides combustion air into two parts. One part enters the combustion area through the series of apertures surrounding the central liquid fuel delivery and another part enters through opening means located near the inner surface of the radiant tube and circumscribing the series of openings.

BRIEF DESCRIPTION OF THE DRAWING

The FIGURE is a partially sectioned view of a dual fuel radiant tube burner constructed in accordance with the present invention.

DETAILED DESCRIPTION OF THE DRAWING

In reference to the FIGURE, a dual fuel radiant tube burner 10 is affixed to a radiant tube 12 by means of a mounting plate 14. The mounting plate 14 supports the gas delivery conduit 16, the air delivery conduit 18 and the housing 20. Affixed and sealed to the end of the air delivery conduit 18 is a flame holding plate 22 which controls the delivery and mixture of fuel and air in the combustion area 24 of the radiant tube 12.

More specifically, the burner 10 is supplied with fuel and air by the combustion air input 26, the gaseous fuel input 28, and liquid fuel input 30 and the atomizing air input 32. An assembly 34 delivers atomizing air and liquid fuel from their respective inputs to a liquid fuel atomizing nozzle 36 in the holding plate 22. The atomizing nozzle 36 may be any suitable nozzle for atomizing the liquid fuel and is firmly seated within an opening 42 in the center of the holding plate 22 to atomize the liquid fuel directly into the combustion area. The specific construction of the assembly 34 will normally depend upon the atomizing means being used. In one embodiment, the assembly 34 comprises an inner conduit (not shown) for the atomizing air and an outer conduit (not shown) for the liquid fuel. In addition, the components numbered 30 to 36 may be removable as a single unit for ease of servicing.

A chamber 44 formed by the housing 20 and an inner plate 46 receives gaseous fuel from the gaseous fuel input 28. The gaseous fuel conduit 16 is affixed to an opening in the inner plate 46 and extends into and along the conduit 18. The conduit 16 terminates short of the flame holding plate 22 for delivery of fuel into the end of the conduit 18 in the vicinity of the holding plate 22. A chamber 50, formed in the housing 20 between plates 46 and 14, surrounds the conduit 16 and receives combustion air through the combustion air input 26. A proportioning means within the chamber 50 divides the combustion air into a first, or primary, stream of combustion air and a secondary stream of combustion air. The proportioning means includes two identical and oppositely situated ports 52 in the wall of the conduit 18 which admit primary combustion air into the conduit. (Only one port 52 is shown in the drawing.) The conduit 18 delivers the primary combustion air, and gaseous fuel if any, to the holding plate 22. In operation, gaseous fuel, if in use, enters the conduit 16 and mixes with primary combustion air on the feed side of the holding plate 22. A series of apertures 48 surrounding the central aperture 42 in the holding plate 22 delivers the primary combustion air and gaseous fuel mixture to the combustion area 24.

A series of ports 54, in communication with the chamber 50, admits secondary combustion air from the chamber 50 into a plenum 55. The plenum 55 is defined by the exterior surface of the conduit 18, the interior of the radiant tube 12, the mounting plate 14 and the holding plate 22. A passage means 57 outward from and circumscribing the series of apertures 48 admits secondary combustion air to flow along a path close to the inner surface 58 of the radiant tube 12 and into the combustion zone 24.

In the illustrated embodiment, the opening means 57 comprises a space between the periphery 56 of the holding plate 22 and the interior surface 58 of the radiant tube 12. In this embodiment, the holding plate 22 is constructed in a shape complimentary to that of the interior of the radiant tube. Individual spacers 60 affixed along the periphery of the holding plate 22 position the holding plate in central alignment with the radiant tube 12, thereby maintaining a substantially even, peripheral gap.

As mentioned, proportioning means within the chamber 50 divides the combustion air into primary combustion air and secondary combustion air. In the illustrated embodiment, the division is controlled by the sizes of the ports 52 and 54. The ports 54 are made relatively large or numerous and the size of the ports 52 is adjusted to provide the limiting constriction and thereby the desired proportioning.

The described embodiment of the present invention may use either heating oil (e.g., #2 fuel oil) or natural gas, either separately or in combination. No mechanical changes are necessary in the present apparatus to switch from one fuel to the other or to use both fuels simultaneously. External adjusting means (not shown) are used to control the input of fuel and air to the burner.

A gas pilot is provided which isolates the ignition means from the combustion area 24. In one embodiment the ignition means is a spark plug 64 which ignites gaseous fuel from a pilot inlet 66. Combustion of this fuel takes place at the end 68 of a delivery tube 70, thus, isolating the spark plug 64 from combustion. This embodiment is only exemplary and any operable ignition means may be used.

In operation, the present invention performs in the following manner. Liquid fuel, if in use, is atomized into the combustion area 24 by the nozzle 36. Primary combustion air passes through the ports 52 and the apertures 48 and is directed into the stream of atomized liquid fuel. The primary combustion air disperses the liquid fuel and delays ignition of at least a portion of it. It has been determined that if the quantity of primary combustion air is too large a fraction of the total combustion air, then the flame will be blown down the radiant tube away from the holding plate 22. If too little of the total combustion air is used as primary air, the atomized fuel ignites too quickly and the combustion does not extend for the entire length of the radiant tube. Generally, if between 15 and 35% of the combined combustion air is used as primary combustion air a proper balance is achieved. Specifically, for the embodiment shown, optimum results are achieved by using between 20 and 25% of the combined combustion air as primary combustion air.

The secondary combustion air enters the combustion area 24 around the periphery 56 of the holding plate 22. The spacers 60 used to maintain even spacing between the periphery of the holding plate 22 and the interior of the radiant tube 12 are of negligible effect.

The amount of noise produced during burner operation is dependent upon the gap between the peripheral edge 56 and the interior surface 58. For example, in a burner for a radiant tube of five inches inner diameter, a gap of less than ($\frac{1}{4}$ inch) achieves acceptable results; a gap of approximately ($\frac{1}{8}$ inch) appears optimum. Also, in a burner for a radiant tube of six inches inner diameter, a gap of less than ($\frac{1}{2}$ inch) achieves acceptable results. Empirically, it has been determined that for a given radiant tube inner diameter, a maximum gap dimension exists below which quiet operation is enhanced. The maximum dimension increases or decreases with increase or decrease, respectively, of radiant tube diameter. In addition, if the gap is increased beyond acceptable limits from the standpoint of burner noise, uniform temperature distribution on the radiant tube 12 is also adversely affected.

As various changes could be made in the above apparatus without departing from the scope of the invention, it should be understood that the embodiment described herein and shown in the accompanying drawing is illustrative and is not to be construed in a limiting sense.

We claim:

1. A radiant tube heater comprising:

an elongated radiant heating tube for radiating internally produced heat energy to its surroundings;

a flame holding plate for dividing said radiant tube between a combustion zone and a feed zone, said plate having a centrally located opening for positioning a liquid fuel atomizing means with respect to said combustion zone to facilitate delivery of atomized fuel to said combustion zone;

means for mounting said flame holding plate within the input end of said radiant tube;

liquid fuel atomizing means positioned within the centrally located opening of said flame holding plate;

means for supplying liquid fuel and atomizing air to said liquid fuel atomizing means;

aperture means in said plate surrounding said opening for directing a first stream of combustion air into liquid fuel delivered to said combustion zone, passage means at the periphery of said plate outward from and circumscribing said aperture means for directing a second stream of combustion air into said combustion zone along the inner surface of said radiant tube;

a combustion air delivery conduit sealingly affixed at one end to the feed side of said plate, said one end surrounding said aperture means and said opening for delivering the first stream of combustion air to said plate;

combustion air delivery means formed between the inside surface of the input end of the radiant tube on the feed side of said flame holding plate and the outside surface of said combustion air delivery conduit for conducting combustion air to said passage means; and means for proportioning combustion air between said combustion air delivery conduit and said combustion air delivery means for dispersing fuel along the radiant tube to produce an elongated flame pattern extending substantially the length of said tube.

2. The burner of claim 1 wherein said combustion air proportioning comprises:

a backplate sealingly mounted to and around said combustion air delivery conduit for closing the input end of said radiant tube;

a portion of said combustion air delivery conduit extending exterior of said radiant tube through said backplate;

an air plenum formed around said combustion air delivery conduit adjacent said backplate and exterior of said radiant tube;

fluid communication means through said backplate from said plenum to the interior of said radiant tube;

means supplying combustion air to said air plenum; and port means within said air plenum in the wall of said combustion air delivery conduit forming a constriction for proportioning combustion air between said first stream and said second stream.

3. The burner of claim 2 further comprising gaseous fuel conduit means extending into and along the interior of said combustion air delivery conduit and terminating short of said flame holding plate to form a fuel outlet within said combustion air delivery conduit.

4. The burner of claim 3 wherein said port means comprises the sole combustion air inlet to said combustion air delivery conduit.

5. The burner of claim 1, further comprising means for mixing gaseous fuel with the first stream of combustion air prior to discharge thereof into said combustion zone.

6. The burner of claim 1 wherein said plate is complimentary in configuration to the interior cross-sectional configuration of said radiant tube and said passage means is formed around the periphery thereof, further comprising a plurality of spacers affixed along the periphery of said plate for holding said plate in central alignment within said radiant tube.

7. The burner of claim 6, wherein the space between said plate and said radiant tube, around the periphery of said plate, is functionally related to the diameter of the radiant tube for enhancing quiet operation.

8. The burner of claim 1, wherein said combustion air divider directs between 15 and 35% of the combined combustion air to said first stream of combustion air.

9. The burner of claim 1, wherein said combustion air divider directs between 20 and 25% of the combined combustion air to said first stream of combustion air.

10. A burner for a radiant tube comprising:

a flame holding plate having a combustion side and a feed side;

means mounting said flame holding plate in central alignment within a radiant tube to thereby define a combustion area adjacent said combustion side of said plate and a plenum chamber inside the radiant tube and adjacent said feed side of said plate; a liquid fuel atomizing means;

means forming a centrally located opening in said flame holding plate for positioning said liquid fuel atomizing means to deliver atomized fuel to said combustion area;

a series of apertures in said plate surrounding said opening for directing a first stream of combustion air into fuel delivered to said combustion side of said plate, said plate being complimentary in surface configuration and smaller than the interior cross-sectional configuration of the radiant tube in which said plate is mounted for allowing a second stream of combustion air to pass around the periphery of said plate and into said combustion area and along the inner surface of said radiant tube;

a delivery conduit sealingly affixed at one end to said feed side of said plate, said one end surrounding said series of apertures and said opening for delivering said first stream of combustion air to said plate;

a second plenum chamber for receiving a supply of forced combustion air, said second plenum chamber communicating with said delivery conduit and the first said plenum chamber; and means for proportioning combustion air received by said second plenum chamber between said delivery conduit and the first said plenum chamber, directing said first stream of combustion air into said delivery conduit and said second stream of combustion air through the first said plenum chamber and past the periphery of said plate, to disperse fuel along said combustion area and produce an elongated flame pattern in said combustion area, thereby to provide an elongated flame pattern extending along the radiant tube in which said flame holding plate is mounted.

11. The burner of claim 10, further comprising a second delivery conduit in communication with the first said delivery conduit for feeding gaseous fuel thereinto.

12. The burner of claim 11 wherein said second delivery conduit extends into and along the first said delivery conduit, said second delivery conduit having an open end for discharging gaseous fuel into the first said delivery conduit downstream of points of introduction for said first stream of combustion air.

* * * * *

UNITED STATES PATENT OFFICE

CERTIFICATE OF CORRECTION

Patent No. 4,098,255 Dated July 4, 1978

Inventor(s) Leonard G. Nowak, Paul K. Shefsiek

It is certified that error appears in the above-identified patent and that said Letters Patent are hereby corrected as shown below:

In the first line of each of claims 2 through 9, the word "burner" should be deleted and the word "heater" substituted therefor.

Signed and Sealed this

*Nineteenth* Day of *December 1978*

[SEAL]

*Attest:*

RUTH C. MASON
*Attesting Officer*

DONALD W. BANNER
*Commissioner of Patents and Trademarks*